US006267090B1

(12) United States Patent
Schneider

(10) Patent No.: US 6,267,090 B1
(45) Date of Patent: Jul. 31, 2001

(54) INTERNAL COMBUSTION ENGINE WITH ROTATABLE ROCKER ARM SHAFT FOR FRICTION REDUCTION

(75) Inventor: Marvin P. Schneider, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/296,107

(22) Filed: Apr. 21, 1999

(51) Int. Cl.[7] ..... F01L 1/18
(52) U.S. Cl. ..... 123/90.39; 123/90.44
(58) Field of Search ..... 123/90.16, 90.17, 123/90.33, 90.36, 90.39, 90.42, 90.44

(56) References Cited

U.S. PATENT DOCUMENTS

| | | | | |
|---|---|---|---|---|
| 3,021,826 | | 2/1962 | Fezzy et al. . | |
| 4,132,196 | * | 1/1979 | Wherry | 123/90.39 |
| 4,627,391 | * | 12/1986 | Derringer | 123/90.39 |
| 4,690,110 | | 9/1987 | Nishimura et al. . | |
| 4,708,101 | | 11/1987 | Hara et al. . | |
| 4,800,850 | | 1/1989 | Yoshida et al. . | |
| 4,829,948 | * | 5/1989 | Yoshida et al. | 123/90.44 |
| 4,848,285 | * | 7/1989 | Konno | 123/90.16 |
| 4,986,227 | | 1/1991 | Dewey, III . | |
| 5,111,781 | | 5/1992 | Kaku et al. . | |
| 5,211,143 | | 5/1993 | Fontichiaro et al. . | |
| 5,253,622 | | 10/1993 | Bornstein et al. . | |
| 5,441,020 | * | 8/1995 | Murata et al. | 123/90.36 |
| 5,445,115 | | 8/1995 | Murata et al. . | |
| 5,445,117 | | 8/1995 | Mendler . | |
| 5,732,669 | * | 3/1998 | Fischer et al. | 123/90.39 |
| 5,960,754 | * | 10/1999 | Sugimoto et al. | 123/90.42 |
| 5,970,932 | * | 10/1999 | Richardson et al. | 123/90.36 |

* cited by examiner

*Primary Examiner*—Thomas Denion
*Assistant Examiner*—Tu M. Nguyen
(74) *Attorney, Agent, or Firm*—Todd T. Taylor

(57) ABSTRACT

An internal combustion engine includes a housing; a camshaft rotatably carried by the housing and having a plurality of cams; a rocker arm shaft rotatably carried by the housing and rotatably driven by the camshaft; and a plurality of rocker arms rotatably carried by the rocker arm shaft, with each rocker arm being associated with a respective cam. The rocker arm shaft and camshaft each include a gear these two gears enmeshing with each other. Rotating the camshaft in turn rotatably drives the rocker arm shaft within the rocker arms.

15 Claims, 1 Drawing Sheet

Fig_1_
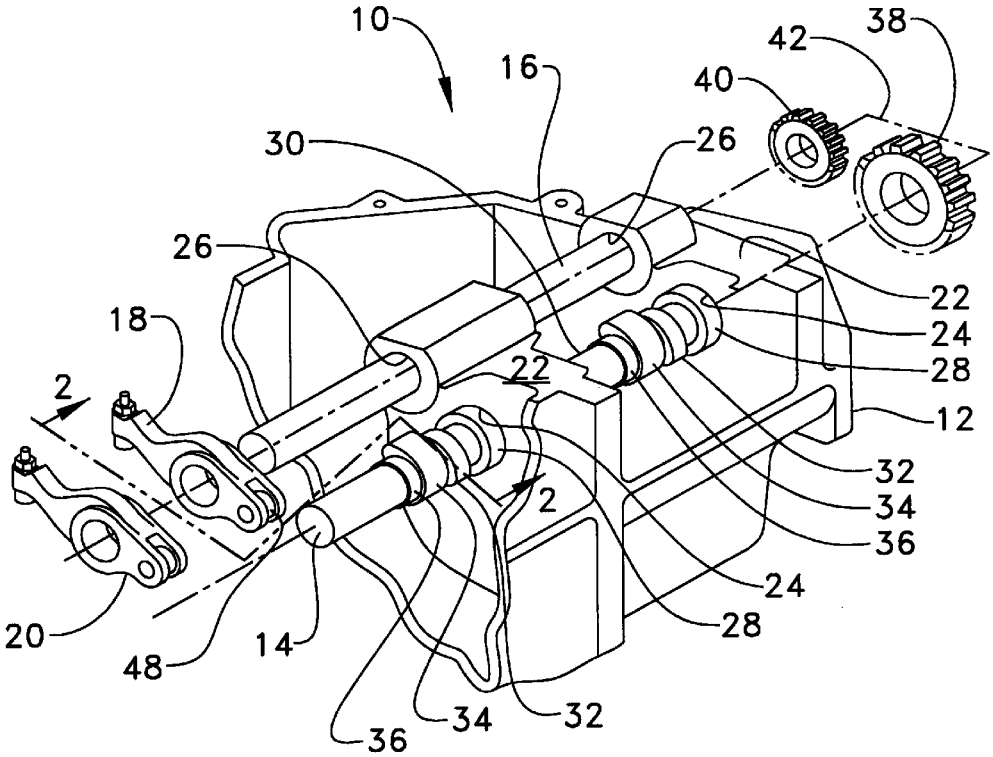
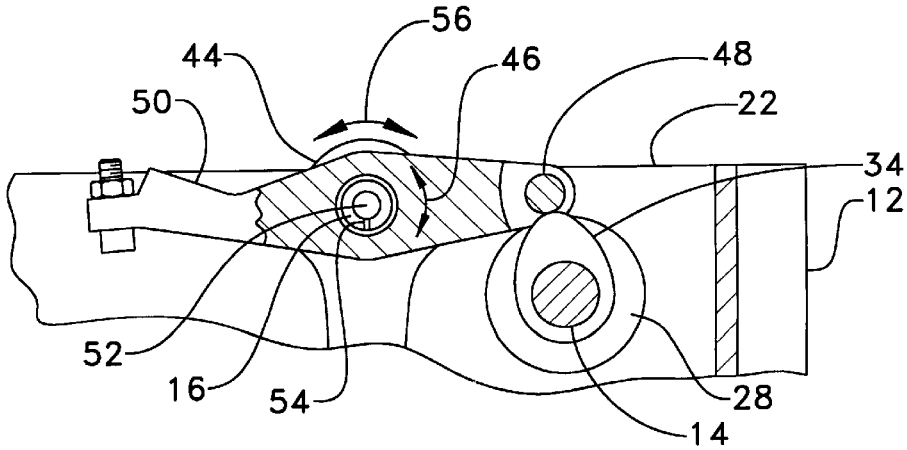
Fig_2_

INTERNAL COMBUSTION ENGINE WITH ROTATABLE ROCKER ARM SHAFT FOR FRICTION REDUCTION

TECHNICAL FIELD

The present invention relates to internal combustion engines, and, more particularly, to internal combustion engines including a rocker arm shaft and rocker arms.

BACKGROUND ART

Internal combustion engines, such as multi-cylinder diesel engines, typically include a crankshaft, a camshaft and a rocker arm shaft. The crankshaft is connected with a plurality of piston rods, which in turn are connected with a plurality of corresponding pistons. Reciprocating movement of the pistons within corresponding combustion cylinders causes rotation of the crankshaft.

The crankshaft is typically interconnected with the camshaft via a gear set and thereby rotatably drives the camshaft during operation. The camshaft includes a plurality of cams, with each cam being associated with an inlet valve, and an exhaust valve or a fuel injector valve. More particularly, the rocker arm shaft carries a plurality of rocker arms, with each rocker arm having a roller follower which engages a corresponding cam on the camshaft. Rotation of the camshaft causes oscillatory pivotal movement of the rocker arms about the rocker arm shaft.

A problem with a conventional internal combustion engine as described above is that the rocker arm shaft is rigidly and immovably carried by a housing. The rocker arms pivot through a relatively small pivoting angle about the stationary rocker arm shaft. The small angle through which the rocker arms pivot is not sufficient to allow the formation of a hydrodynamic oil film between the rocker arms and the rocker arm shaft. As a result, the friction between the rocker arms and the rocker arm shaft may be relatively high and the energy required to pivot the rocker arms is increased. This decreases the efficiency of the engine. Additionally, the increased friction may cause increased wear or spalling between the rocker arms and the rocker arm shaft.

It is known to oscillate a rocker arm shaft through a small rotational angle using a rack and pinion arrangement in order to change the eccentricity of the rocker arms relative to the rocker arm shaft. However, the rocker arm shaft does not continuously or fully rotate within the rocker ends. Such a slight pivotal movement is not sufficient to create a hydrodynamic oil film between the rocker arm shaft and the rocker arms, or to reduce friction or improve efficiency of the internal combustion engine. An example of an internal combustion engine including such a rocker arm shaft is disclosed in U.S. Pat. No. 5,111,781 (Kaku, et al).

The present invention is directed to overcoming one or more of the problems as set forth above.

DISCLOSURE OF THE INVENTION

In one aspect of the invention, an internal combustion engine includes a housing; a camshaft rotatably carried by the housing and having a plurality of cams; a rocker arm shaft rotatably carried by the housing and rotatably driven by the engine; and a plurality of rocker arms rotatably carried by the rocker arm shaft, with each rocker arm being associated with a respective cam.

In another aspect of the invention, a method of operating an internal combustion engine includes the steps of: providing a rocker arm shaft and a plurality of rocker arms carried by and rotatable relative to the rocker arm shaft; and rotating the rocker arm shaft within the rocker arms.

BRIEF DESCRIPTION OF THE DRAWINGS

FIG. 1 is a fragmentary, perspective view of an embodiment of an internal combustion engine of the present invention; and FIG. 2 is a sectional view taken along line 2—2 in FIG. 1, illustrating the interrelationship between the camshaft and rocker arm shaft when assembled.

BEST MODE FOR CARRYING OUT THE INVENTION

Referring now to the drawings and particularly to FIG. 1, there is shown a fragmentary, perspective view of a portion of an embodiment of an internal combustion engine 10 of the present invention which generally includes a housing 12, camshaft 14, rocker arm shaft 16 and a plurality of rocker arms 18 and 20.

Housing 12 includes a plurality of blocks 22, each block 22 including a hole 24. Holes 24 are axially aligned with each other and rotatably carry camshaft 14 therein. Blocks 22 also each include a bearing surface 26 which are axially aligned with each other and rotatably carry rocker arm shaft 16, as will be described in further detail hereinafter.

Camshaft 14 includes a plurality of bearing surfaces 28. A cam set 30, including an inlet cam 32, fuel injection cam 34 and exhaust cam 36, is disposed between each adjacent pair of bearing surfaces 28. Each cam set 30 corresponds to a combustion cylinder within housing 12, in a known manner. Each bearing surface 28 on camshaft 14 is disposed within and rotatably carried by a corresponding hole 24 in housing 12. When installed within housing 12, each cam set 30 is disposed between an adjacent pair of blocks 22 in housing 12. For ease of description, only two bearing surfaces 28 and two cam sets 30 are shown in FIG. 1. However, it is to be understood that internal combustion engine 10 likely includes multiple combustion cylinders, with an adjacent pair of bearing surfaces 28 and a cam set 30 associated with each combustion cylinder.

Rocker arm shaft 16 is rotatably carried by bearing surfaces 26 of housing 12. In the embodiment shown, housing 12 includes a plurality of axially aligned bearing surfaces in the form of holes through which rocker arm shaft 16 extends, similar to holes 24 carrying cam shaft 14. However, housing 12 may include a plurality of hemi-cylindrical shaped bearing surfaces and another housing part (not shown) with a plurality of hemi-cylindrical shaped bearing surfaces which are complimentary to the hemi-cylindrical bearing surfaces 26 of housing 12. When assembled, a slight radial clearance would exist between the outside diameter of rocker arm shaft 16 and the inside diameter of bearing surfaces 26. Rocker arm shaft 16 would thus be captured within and rotatably carried by housing 12. Of course, housing 12 may be differently configured to rotatably carry rocker arm shaft 16.

Camshaft 14 includes a gear 38 which is attached to an end of camshaft 14 which extends through housing 12. Likewise, rocker arm shaft 16 includes a gear 40 which is attached to an end of rocker arm shaft 16 extending through housing 12. Camshaft 14 is driven in a known manner through an interconnection with a crankshaft (not shown) disposed within housing 12. For example, gear 38 of camshaft 14 may be interconnected through a planetary gear set with the crankshaft disposed within housing 12.

According to an aspect of the present invention, camshaft 14 rotatably drives rocker arm shaft 16 within housing 12. More particularly, gear 38 of camshaft 14 is connected with and rotatably drives gear 40 of rocker arm shaft 16 in a direction, indicated schematically by dashed line 42. For example, gear 38 may be interconnected with a rotatably drive gear 40 through an intervening planetary gear set (not shown) carried by housing 12.

FIG. 2 illustrates rocker arm 18 when in an assembled state on rocker arm shaft 16. Rocker arm 18 is used to actuate an inlet valve (not shown) within housing 12. Rocker arm 18 includes a reduced friction bearing 44 which is press fit therein. In the embodiment shown, bearing 44 is in the form of a bronze bushing with an inside diameter which is slightly larger than the outside diameter of rocker arm shaft 16. Rocker arm 18 is thus free to pivot or rotate about rocker arm shaft 16, as indicated by rotational arrow 46. Rocker arm 18 need not necessarily be provided with a bearing 44, or may be provided with a different type of bearing.

Rocker arm shaft 16 includes a longitudinally extending bore 52 and a plurality of radially extending lube holes 54. Each lube hole 54 is associated with a rocker arm 18 or 20 and extends to the annular space adjacent bearing 44. In the embodiment shown, rocker arm shaft 16 includes a single lube hole 54 associated with each rocker arm 18 and 20. However, rocker arm shaft 16 may include a different number of lube holes 54 associated with each rocker arm 18 or 20, such as two lube holes 54 for each rocker arm 18 or 20. A source of pressurized lube oil is provided within bore 52 and flows to the annular space between rocker arm shaft 16 and bearings 44 to allow easier oscillatory pivotal movement therebetween.

Rocker arm 18 also includes a roller 48 which rolls against inlet cam 32 of camshaft 14 in a known manner. Rotation of camshaft 14 within housing 12 causes corresponding oscillatory pivotal movement of rocker arm 18 relative to rocker arm shaft 16, as indicated by arrow 56. An opposing arm 50 of rocker arm 15 is used to actuate an inlet valve (not shown) carried by housing 12.

In the embodiment of internal combustion engine 10 described above, rocker arm shaft 16 is rotatably driven by camshaft 14 through a geared interconnection therebetween. However, it is to be appreciated that rocker arm shaft 16 may be rotatably driven by sources other than camshaft 14. For example, rocker arm shaft 16 may be rotatably driven through a geared interconnection with the crankshaft of internal combustion engine 10, or may be rotatably driven using a hydraulic, electric or pneumatic motor, etc.

INDUSTRIAL APPLICABILITY

During operation of internal combustion engine 10, camshaft 14 is driven by a crankshaft (not shown) to cause camshaft 14 to rotate within holes 24 in housing 12. Rotation of camshaft 14, in turn, causes oscillatory pivotal movement of rocker arms 18 and 20 about rocker arm shaft 16. Concurrently, gear 38 of camshaft 14 rotatably drives gear 40 and rocker arm shaft 16. Thus, in addition to the oscillatory movement between rocker arms 18 and 20, rocker arm shaft 16 also rotates within rocker arms 18 and 20. The rotational movement of rocker arm shaft 16 causes the pressurized lube oil within bore 52 to flow into the annular space between the outside diameter of rocker arm shaft 16 and the inside diameter of rocker arms 18 and 20, thus creating a hydrodynamic oil film between rocker arm shaft 16 and rocker arms 18 and 20. The hydrodynamic oil film inhibits wear between bearings 44 within rocker arms 18 and 20. Moreover, the hydrodynamic oil film allows easier oscillatory pivotal movement between rocker arms 18 and 20 and rocker arm shaft 16, thereby reducing the force necessary to effect the oscillatory pivotal movement and improving engine efficiency.

Other aspects, objects and advantages of this invention can be obtained from a study of the drawings, the disclosure and the appended claims.

What is claimed is:

1. A method of operating an internal combustion engine, comprising the steps of:

providing a rocker arm shaft and a plurality of rocker arms carried by said rocker arm shaft, each rocker arm being separate from and at least one of freely pivotable and freely rotatable relative to said rocker arm shaft, each rocker arm having an elongate expanse, said elongate expanse including a first operative end and a second operative end, each rocker arm being mounted on said rocker arm shaft at a position between said first operative end and said second operative end of said each rocker arm; and rotating said rocker arm shaft within said rocker arms, said rocker arm shaft being rotated independently of said rocker arms.

2. The method of claim 1, comprising the further steps of:

providing a camshaft including a plurality of cams and a gear;

providing said rocker arm shaft with a gear enmeshing with said gear on said camshaft; and rotatably driving said camshaft to in turn rotatably drive said rocker arm shaft through said gears.

3. The method of claim 1, wherein said rocker arm shaft includes a longitudinally extending bore and a plurality of radially extending lube holes, each said lube hole connected with said bore and being associated with a respective said rocker arm, and comprising the further step of providing a pressurized lube oil within said bore, and wherein said rotating step includes the substep of creating a hydrodynamic oil film between said rocker arm shaft and each said rocker arm.

4. An internal combustion engine, comprising:

a housing;

a camshaft rotatably carried by said housing and including a plurality of cams;

a rocker arm shaft rotatably carried by said housing and rotatably driven by said camshaft; and a plurality of rocker arms rotatably carried by said rocker arm shaft, each rocker arm having an elongate expanse, said elongate expanse including a first operative end and a second operative end, said first operative end being operatively associated with a respective said cam, said second operative end for actuating an engine valve, each rocker arm being mounted on said rocker arm shaft at a position between said first operative end and said second operative end of said each rocker arm.

5. An internal combustion engine, comprising:

a housing;

a rotational drive source;

a rocker arm shaft rotatably carried by said housing and rotatably driven in a single direction by said rotational drive source; and a plurality of rocker arms rotatably carried by said rocker arm shaft, each rocker arm being separate from and at least one of freely pivotable and freely rotatable relative to said rocker arm shaft, each rocker arm having an elongate expanse, said elongate expanse including a first operative end and a second operative end, each rocker arm being mounted on said rocker arm shaft at a position between said first operative end and said second operative end of said each rocker arm.

6. The internal combustion engine of claim 5, wherein said rotational drive source comprises a camshaft rotatably carried by said housing and including a plurality of cams, and wherein each said rocker arm is associated with a respective said cam.

7. An internal combustion engine, comprising:

a housing;

a camshaft rotatably carried by said housing and including a plurality of cams;

a rocker arm shaft rotatably carried by said housing and rotatably driven in a single direction by said camshaft; and a plurality of rocker arms rotatably carried by said rocker arm shaft, each rocker arm having an elongate expanse, said elongate expanse including a first operative end and a second operative end, said first operative end being operatively associated with a respective said cam, each rocker arm being separate from and at least one of freely pivotable and freely rotatable relative to said rocker arm shaft, each rocker arm being mounted on said rocker arm shaft at a position between said first operative end and said second operative end of said each rocker arm.

8. The internal combustion engine of claim 1, wherein said rocker arm shaft includes a gear and said camshaft includes a gear, said gear on said camshaft rotatably driving said gear on said rocker arm shaft.

9. The internal combustion engine of claim 1, wherein said first operative end includes a roller follower which rolls against a respective said cam.

10. The internal combustion engine of claim 7, wherein said rocker arm shaft includes a longitudinally extending bore and a plurality of radially extending lube holes, each said lube hole connected with said bore and being associated with a respective said rocker arm.

11. The internal combustion engine of claim 10, wherein one said lube hole is associated with each said rocker arm.

12. The internal combustion engine of claim 7, wherein each said rocker arm includes a bearing disposed around said rocker arm shaft.

13. The internal combustion engine of claim 12 wherein each said bearing comprises a bushing.

14. The internal combustion engine of claim 13, wherein each said bushing comprises a bronze bushing.

15. The internal combustion engine of claim 12, wherein each said bearing is press fit into a corresponding said rocker arm.

* * * * *